US009940917B1

(12) United States Patent
Kawase

(10) Patent No.: US 9,940,917 B1
(45) Date of Patent: Apr. 10, 2018

(54) NOISE GENERATING CLAPPER APPARATUS

(71) Applicant: Yasuteru Kawase, Torrance, CA (US)

(72) Inventor: Yasuteru Kawase, Torrance, CA (US)

( * ) Notice: Subject to any disclaimer, the term of this patent is extended or adjusted under 35 U.S.C. 154(b) by 0 days.

(21) Appl. No.: 15/376,475

(22) Filed: Dec. 12, 2016

Related U.S. Application Data

(60) Provisional application No. 62/265,932, filed on Dec. 10, 2015.

(51) Int. Cl.
*A63H 5/00* (2006.01)
*G10K 3/00* (2006.01)
*G10K 1/00* (2006.01)

(52) U.S. Cl.
CPC ..... *G10K 3/00* (2013.01); *A63H 5/00* (2013.01); *G10K 1/00* (2013.01)

(58) Field of Classification Search
CPC . A63H 5/00; A63H 37/00; G10K 3/00; G10K 1/00; G10K 1/07; G10K 15/00; G10K 15/04
See application file for complete search history.

(56) References Cited

U.S. PATENT DOCUMENTS 879,917 A * 2/1908 Seiler ..... A63H 5/00 446/203
1,401,859 A * 12/1921 Bailey ..... A63H 5/00 446/419
1,672,248 A * 6/1928 Covel ..... A63H 5/00 446/421
2,517,665 A * 8/1950 Hochstein ..... G10K 11/08 181/178
4,000,579 A * 1/1977 Gornall ..... A63H 5/00 446/297
4,019,277 A * 4/1977 Kenkelen ..... A63H 5/00 446/418
4,810,228 A 3/1989 Huggins
2007/0108258 A1* 5/2007 Taylor ..... B65D 5/029 229/103
2010/0227528 A1* 9/2010 Weiss ..... A63H 5/00 446/397

FOREIGN PATENT DOCUMENTS

JP 2012003291 A * 1/2012

* cited by examiner

*Primary Examiner* — Gene Kim
*Assistant Examiner* — Alyssa Hylinski
(74) *Attorney, Agent, or Firm* — Plager Schack LLP

(57) ABSTRACT

A noise generating clapper apparatus includes a main body sheet having a plurality of foldable flaps, the plurality of flaps having a front flap attached to a rear flap along a first fold line and a joint flap attached to the rear flap along a second fold line, and a clapper member pivotably mounted to the joint flap. The joint flap folds along the second fold line and the front flap folds along the first fold line to enclose the clapper member between the front and rear flaps in a secured position. The main body sheet is maneuvered in a shaking motion to permit the clapper member to pivot between the front and rear flaps, thereby enabling the clapper member to generate noise upon contact with the first fold line of the main body sheet.

10 Claims, 4 Drawing Sheets

NOISE GENERATING CLAPPER APPARATUS

RELATED APPLICATION

The application claims priority to provisional patent application U.S. Ser. No. 62/265,932 filed on Dec. 10, 2015, the entire contents of which is herein incorporated by reference.

BACKGROUND

The embodiments herein relate generally to noise generating devices.

Noise generating devices and methods are desirable in certain environments such as sporting events, concerts, parades, and other corporate and/or organizational events. In many instances, individuals clap their hands together to generate noise at the particular event. However, in certain circumstances, the manual clapping of hands is not sufficient to generate the level of noise desired.

Noise generating devices such as clappers exist as disclosed in U.S. Pat. No. 4,810,228. The disclosed clapper device comprises blades pivotably coupled together. However, this clapper device is inefficient and difficult to maneuver because the user is required to grab the device with one hand and contract the blades together with the other hand or against another portion of the user's body. Other clapper devices are undesirable due to their inherent bulk and weight that results from the manufacturing process used, such as injection molding. When goods are produced in this way, the components of the product must be assembled independently and connected together, which results in higher defect rates.

As such, there is a need in the industry for a noise generating clapper apparatus that addresses the limitations of the prior art, which more effectively produces noise with reduced user effort and enhanced ease of use. There is a further need for a noise generating clapper apparatus that reduces manufacturing costs.

SUMMARY

A noise generating clapper apparatus for use by a user to enhance noise generation and reduce user effort is provided. The noise generating clapper apparatus comprises a main body sheet comprising a plurality of foldable flaps, the plurality of flaps comprising a front flap directly attached to a rear flap along a first fold line, and a joint flap directly attached to the rear flap along a second fold line, and a clapper member pivotably mounted to the joint flap, wherein the joint flap is configured to fold along the second fold line and the front flap is configured to fold along the first fold line to enclose the clapper member between the front and rear flaps in a secured position, wherein the main body sheet is maneuvered in a shaking motion to permit the clapper member to pivot in a first direction and a second direction between the front and rear flaps, thereby enabling the clapper member to generate noise upon contact with the first fold line of the main body sheet.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
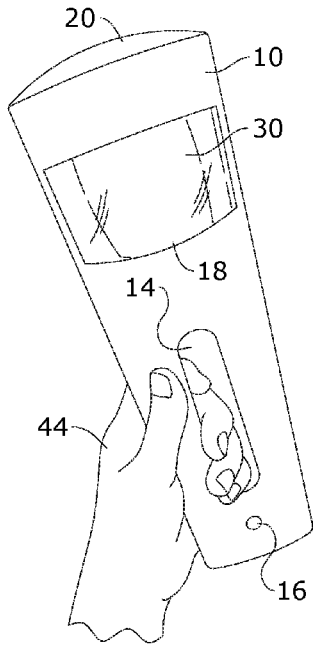
FIG. 1 depicts a perspective view of certain embodiments of the noise generating clapper apparatus shown in use.

As depicted in FIGS. 1-4 and 8, the noise generating clapper apparatus is configured for use by user 44 to generate a desired level of noise with reduced user effort. The noise generating clapper apparatus generally comprises front flap 10, rear flap 20, joint flap 28 and clapper 30. The noise generating clapper apparatus is die cut from a single sheet of polypropylene that is approximately 3 millimeters thick. The cut sheet of polypropylene is folded as shown in FIGS. 1-4 to a secured and compact position when used to generate noise.

Figure 4:
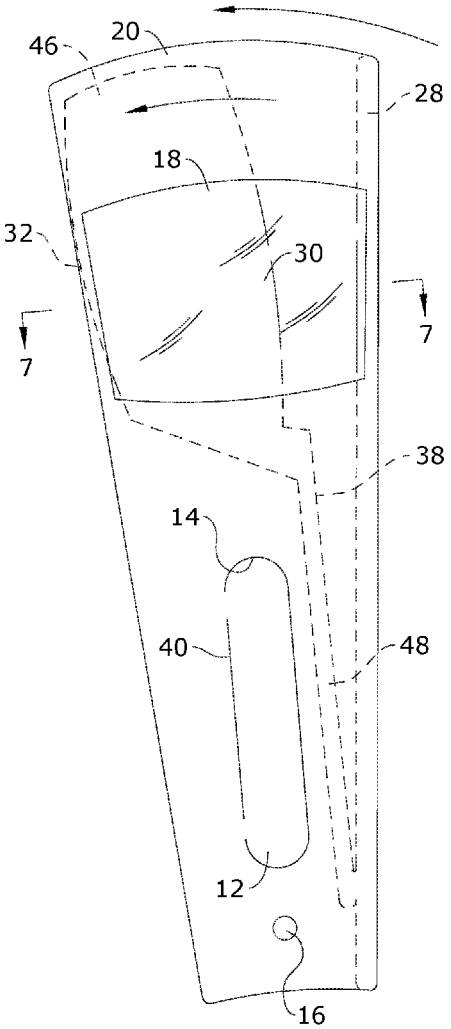
FIG. 4 depicts a front view of certain embodiments of the noise generating clapper apparatus illustrating the pivotal movement of clapper 30.
Figure 8:
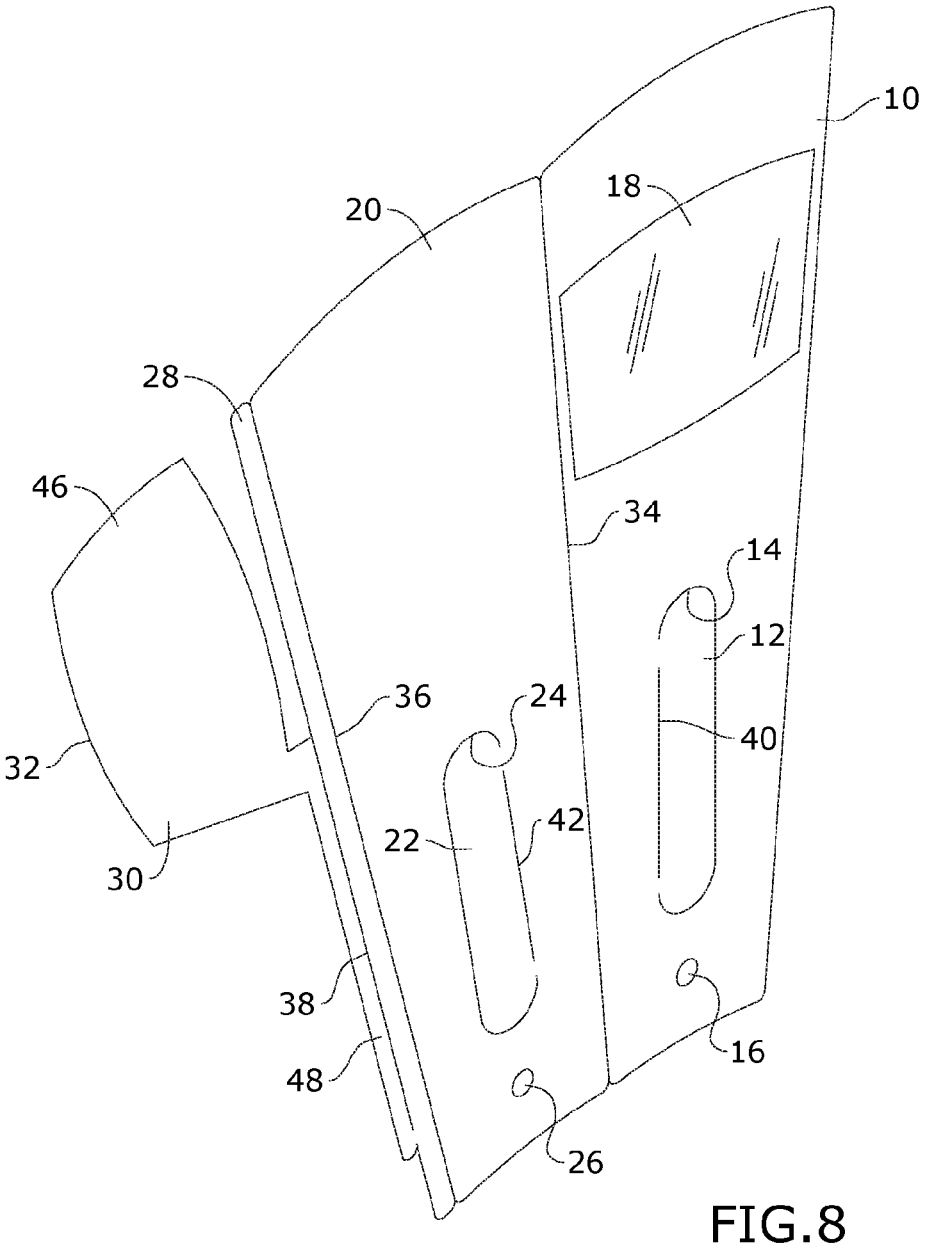
FIG. 8 depicts a perspective view of certain embodiments of the noise generating clapper apparatus.

As depicted in FIG. 8 the noise generating clapper apparatus comprises front flap 10 directly attached to rear flap 20 along first fold line 34 and joint flap 28 directly attached to rear flap 20 along second fold line 36. Joint flap 28 is a sonic welded flap coupled to rear flap 20. In one embodiment, front flap 10 comprises viewing window 18. Clapper 30 is pivotably mounted to joint flap 28 and comprises head member 46 coupled to arm member 48. Arm member 48 comprises a bottom portion coupled to joint flap 28. The remaining portion of arm member 48 is separated from joint flap 28 along cut line 38. Cut line 38 permits clapper 30 to pivot relative to joint flap 28 as shown in FIG. 4. Head member 46 of clapper 30 comprises edge 32, which is configured to contact first fold line 34 of noise generating clapper apparatus to generate noise.

As depicted in FIG. 8, front flap 10 comprises front handle slot 14 and front handle flap 12. Front handle flap 12 is pivotably mounted to an edge of front handle slot 14 along fold line 40. Similarly, rear flap 20 comprises rear handle slot 24 and rear handle flap 22. Rear handle flap 22 is pivotably mounted to an edge of rear handle slot 24 along fold line 42. In certain embodiments, front flap 10 comprises first aperture 16 and rear flap 20 comprises second aperture 26.

Figure 2:
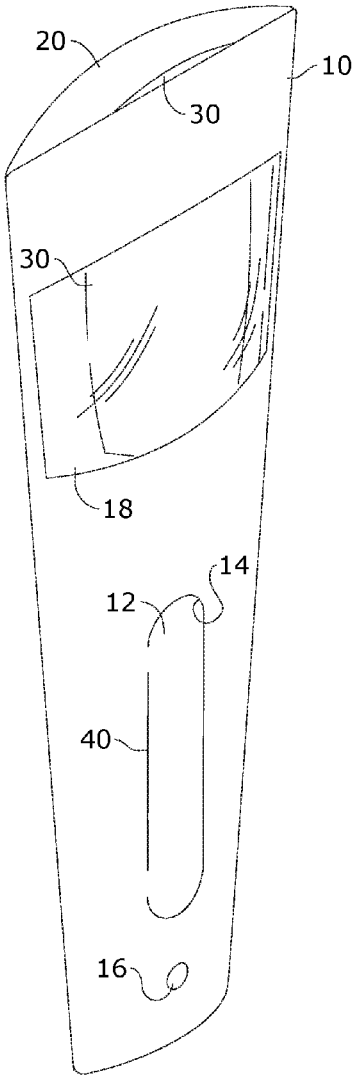
FIG. 2 depicts a perspective view of certain embodiments of the noise generating clapper apparatus.
Figure 3:
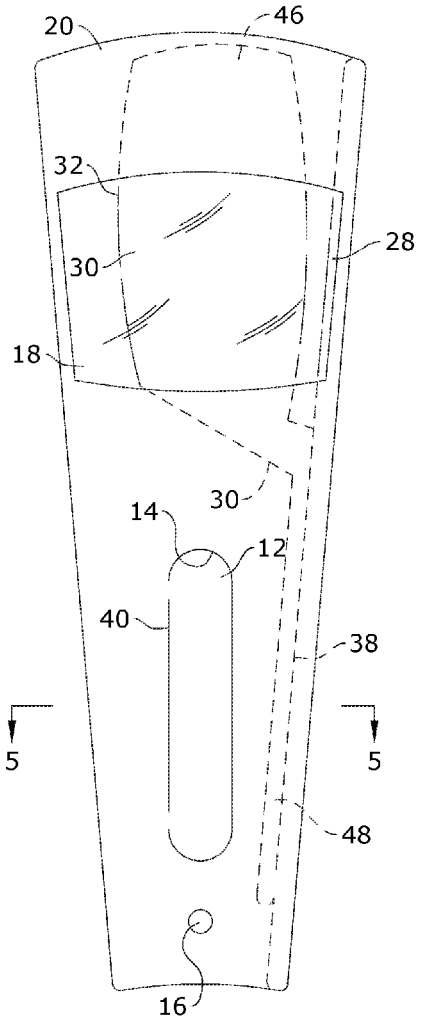
FIG. 3 depicts a front view of certain embodiments of the noise generating clapper apparatus.
Figure 5:
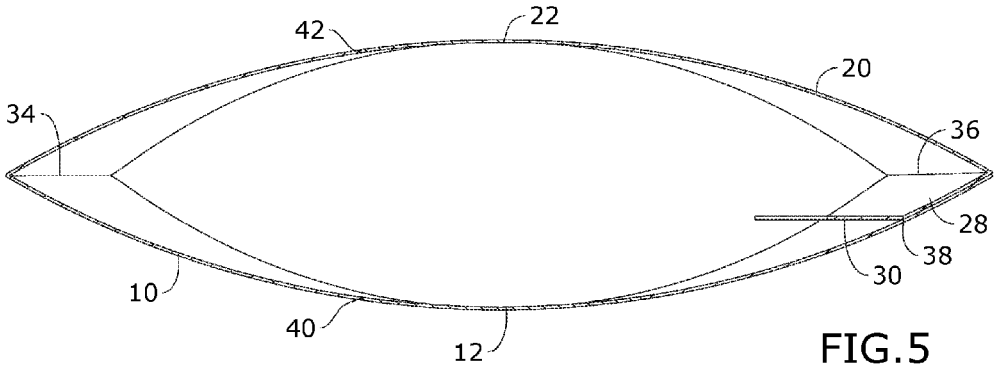
FIG. 5 depicts a section view of certain embodiments of the noise generating clapper apparatus taken along line 5-5 in FIG. 3.

To operate the noise generating clapper apparatus, front flap 10, rear flap 20 and joint flap 28 are folded into a secured position. More specifically, joint flap 28 is folded along second fold line 36 and front flap 10 is folded along first fold line 34 as depicted in FIGS. 2-3 and 5. This encloses clapper 30 between front and rear flaps 10, 20. In this secured position, front handle slot 14 of front flap 10 is aligned with rear handle slot 24 of rear flap 20. Similarly, first aperture 16 is aligned with second aperture 26. First and second apertures 16, 26 are configured to receive a lanyard (not shown). In one embodiment, the noise generating clapper apparatus in the folded and secured position comprises approximate dimensions of a 12" height, 4.3" top width and 2.25" bottom width.

Figure 6:
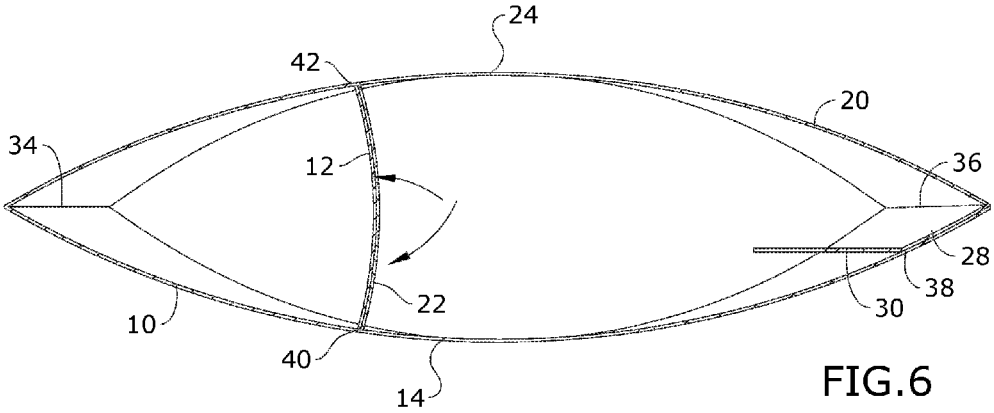
FIG. 6 depicts a section view of certain embodiments of the noise generating clapper apparatus illustrating the folding of rear handle flap 22 and front handle flap 12.
Figure 7:
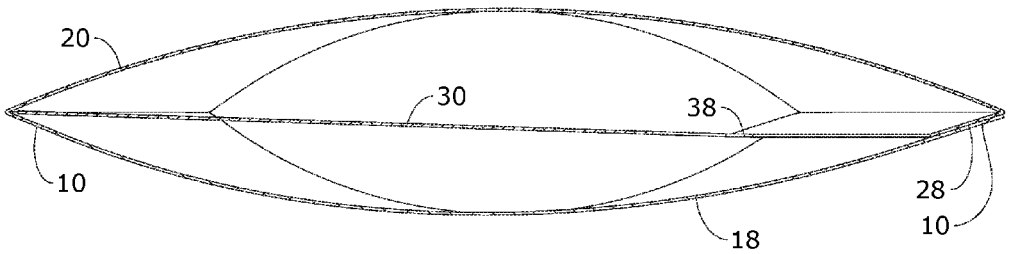
FIG. 7 depicts a section view of certain embodiments of the noise generating clapper apparatus taken along line 7-7 in FIG. 4.

As depicted in FIGS. 1 and 6, front handle flap 12 is folded along fold line 40 and rear handle flap 22 is folded along fold line 42. This exposes front and rear handle slots 14, 24 to receive fingers of user 44. User 44 maneuvers the noise generating clapper apparatus in a repeated forward and backward shaking motion. This causes clapper 30 to pivot in a forward direction and a backward direction relative to joint flap 28. As depicted in FIGS. 4 and 7, the pivotal movement of clapper 30 causes head member 46 to contact first fold line 34 and/or second fold line 36 of the apparatus. This contact between clapper 30 and first or second fold lines 34, 36 generates noise. The generated noise reflects off interior surfaces of front and rear flaps 10, 20 to amplify the generated noise. The rigidity of the polypropylene front flap 10, rear flap 20, joint flap 28 and clapper 30 enhances strength and permits the noise generating clapper apparatus to function without damaging the components.

It shall be appreciated that the components of the noise generating clapper apparatus described in several embodiments herein may comprise any alternative known materials in the field and be of any color, size and/or dimensions. It shall be appreciated that the components of the noise generating clapper apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A noise generating clapper apparatus for use by a user to enhance noise generation and reduce user effort, the noise generating clapper apparatus comprising:

a main body sheet comprising a plurality of foldable flaps, the plurality of flaps comprising a front flap directly attached to a rear flap along a first fold line, and a joint flap directly attached to the rear flap along a second fold line; and a clapper sheet member pivotably mounted and continuously connected to the joint flap, the clapper sheet member comprising a head member continuously connected to an arm member, the arm member pivotably mounted to the joint flap;

wherein the noise generating clapper apparatus is configured to adjust to a folded configuration to permit the joint flap to fold along the second fold line and the front flap to fold along the first fold line to enclose the clapper sheet member between the front and rear flaps in a secured position, wherein the main body sheet is maneuvered in a shaking motion to permit the clapper sheet member to pivot in a first direction and a second direction between the front and rear flaps, thereby enabling the head member of the clapper sheet member to generate noise upon contact with the first fold line of the main body sheet.

2. The noise generating clapper apparatus of claim 1, wherein the noise generated by the clapper sheet member is configured to reflect off the front and rear flaps to amplify the generated noise.

3. The noise generating clapper apparatus of claim 2, wherein the front flap comprises a first slot and the rear flap comprises a second slot, the first and second slots being aligned together when the front and rear flaps are in the secured position, wherein the first and second slots are configured to receive fingers of the user.

4. The noise generating clapper apparatus of claim 3, further comprising a first slot flap pivotably mounted to an edge of the first slot and a second slot flap pivotably mounted to an edge of the second slot.

5. The noise generating clapper apparatus of claim 4, further comprising a first aperture disposed in the front flap and a second aperture disposed in the rear flap, the first and second apertures being aligned together when the front and rear flaps are in the secured position.

6. The noise generating clapper apparatus of claim 5, wherein the front and rear flaps of the main body sheet comprise symmetric halves of each other.

7. The noise generating clapper apparatus of claim 6, wherein the front flap comprises a viewing window.

8. The noise generating clapper apparatus of claim 7, wherein the main body sheet comprises a thickness of approximately 3 millimeters.

9. The noise generating clapper apparatus of claim 8, wherein the main body sheet and clapper member are both made from polypropylene.

10. A noise generating clapper apparatus for use by a user to enhance noise generation and reduce user effort, the noise generating clapper apparatus comprising:

a main body sheet comprising a plurality of foldable flaps, the plurality of flaps comprising a front flap directly attached to a rear flap along a first fold line, and a joint flap directly attached to the rear flap along a second fold line; and a clapper sheet member pivotably mounted and continuously connected to the joint flap, the clapper sheet member comprising a head member continuously connected to an arm member, the arm member comprising a first end coupled to the head member and a second end pivotably mounted to a lower portion of the joint flap;

wherein the noise generating clapper apparatus is configured to adjust to a folded configuration to permit the joint flap to fold along the second fold line and the front flap to fold along the first fold line to enclose the clapper sheet member between the front and rear flaps in a secured position, wherein the main body sheet is maneuvered in a shaking motion to permit the clapper sheet member to pivot in a first direction and a second direction between the front and rear flaps, thereby enabling the head member of the clapper sheet member to generate noise upon contact with the first fold line of the main body sheet.

* * * * *